US005850754A

United States Patent [19]

Dobbins

[11] Patent Number: 5,850,754

[45] Date of Patent: Dec. 22, 1998

[54] CAR ALARM CONTROLLER HOLDER SYSTEM

[76] Inventor: Kirk G. Dobbins, 15715 Birch River, Houston, Tex. 77082

[21] Appl. No.: 967,428

[22] Filed: Nov. 10, 1997

[51] Int. Cl.[6] ..... A45C 11/32

[52] U.S. Cl. ..... 70/456 R; 206/37; 206/38; 206/305

[58] Field of Search ..... 70/456 R, 457–460; 206/305, 37, 37.1, 37.4, 37.5, 37.6, 37.7, 37.8, 38, 38.1

[56] References Cited

U.S. PATENT DOCUMENTS

| | | | |
|---|---|---|---|
| 1,666,117 | 4/1928 | Burrell | 206/38.1 |
| 2,541,333 | 2/1951 | Campbell | 150/40 |
| 3,294,137 | 12/1966 | Rubenstein | 150/40 |
| 3,613,416 | 10/1971 | Paton | 206/37.1 X |
| 4,310,040 | 1/1982 | Shainfeld | 150/40 |
| 4,836,256 | 6/1989 | Meliconi | 206/305 X |
| 5,092,459 | 3/1992 | Uljanic et al. | 206/305 X |
| 5,388,691 | 2/1995 | White | 206/305 |
| 5,511,390 | 4/1996 | Mah | 63/1.1 |
| 5,769,212 | 6/1998 | Collins | 206/38 |

*Primary Examiner*—Lloyd A. Gall
*Attorney, Agent, or Firm*—Joseph N. Breaux

[57] ABSTRACT

A car alarm controller holder system that includes a main holder assembly into which the alarm controller is positioned, a key ring attachable insertion opening cover for use with alarm controllers without a key ring attachment structure and a controller key ring insertion opening cover for use with alarm controllers that are provided with a key ring attachment structure.

16 Claims, 3 Drawing Sheets

CAR ALARM CONTROLLER HOLDER SYSTEM

TECHNICAL FILED

The present invention relates to cases and holders for electronic equipment and more particularly to a car alarm controller holder system for protecting the remote alarm controller of a car alarm that includes a main holder assembly, a key ring attachable insertion opening cover, and a controller key ring insertion opening cover; the main holder assembly including a replaceable, transparent, flexible controller access opening cover and a controller receiving member; the controller receiving member including a top insertion opening, front and back indents, a front controller access opening, a front insertion opening cover securing mechanism, and two back insertion opening cover securing mechanisms; the main holder assembly defining a controller receiving compartment therein into which a left and a right retainer channel member extends; the controller access opening cover being positioned over the front controller access opening of the controller receiving member and held in position by the left and right retainer channel members; the key ring attachable insertion opening cover including a channel shaped cover portion and a key ring attachment portion; the channel shaped cover portion including a front panel with a front cover securing mechanism, a top panel and a rear panel with two back cover securing mechanisms; the key ring attachment portion extending outwardly from the channel shaped cover portion and including a key ring receiving aperture formed through an attachment end thereof; the controller key ring insertion opening cover including a channel shaped cover portion including a curved front panel with a front securing mechanism and a front cover indent, a left top panel, a right top panel, a rear panel with a back cover indent and two back securing mechanisms; the controller key ring insertion opening cover including a controller key ring portion pass through opening formed between the left and right top panels.

BACKGROUND ART

Car alarms typically include a remote control alarm controller that is carried by the vehicle owner and that is used to activate and deactivate the car alarm as needed. Because the alarm controller is carried extensively, it can become dirty, and is subject to contact and damage by other items when carried in a pocket or purse. It would be a benefit, therefore, to have an alarm controller holder that included a compartment within which the alarm controller could be safely contained and that included a controller access opening that was covered by a transparent, flexible controller access opening cover that allowed a user to manipulate the buttons on the alarm controller by pressing onto the access opening cover. Because the access cover could become scratched and dirty, it would be a benefit to have an access cover that could be replaced by the user. In addition, because some alarm controllers include a key ring attachment structure and others do not, it would be a benefit to have a car alarm controller holder system that included a main holder assembly into which the alarm controller is positioned, a key ring attachable insertion opening cover for use with alarm controllers without a key ring attachment structure and a controller key ring insertion opening cover for use with alarm controllers that are provided with a key ring attachment structure.

GENERAL SUMMARY DISCUSSION OF INVENTION

It is thus an object of the invention to provide a car alarm controller holder system for holding and protecting the alarm controller of a car alarm.

It is a further object of the invention to provide a car alarm controller holder system that includes an alarm controller receiving compartment within which an alarm controller can be safely contained and that includes a controller access opening that is covered by a transparent, flexible controller access opening cover.

It is a further object of the invention to provide a car alarm controller holder system that includes a controller access opening that is covered by a replaceable transparent, flexible controller access opening cover.

It is a further object of the invention to provide a car alarm controller holder system that includes a main holder assembly into which the alarm controller is positioned, a key ring attachable insertion opening cover for use with alarm controllers without a key ring attachment structure and a controller key ring insertion opening cover for use with alarm controllers that are provided with a key ring attachment structure.

It is a still further object of the invention to provide a car alarm controller holder system that includes a main holder assembly, a key ring attachable insertion opening cover, and a controller key ring insertion opening cover; the main holder assembly including a replaceable, transparent, flexible controller access opening cover and a controller receiving member; the controller receiving member including a top insertion opening, front and back indents, a front controller access opening, a front insertion opening cover securing mechanism, and two back insertion opening cover securing mechanisms; the main holder assembly defining a controller receiving compartment therein into which a left and a right retainer channel member extends; the controller access opening cover being positioned over the front controller access opening of the controller receiving member and held in position by the left and right retainer channel members; the key ring attachable insertion opening cover including a channel shaped cover portion and a key ring attachment portion; the channel shaped cover portion including a front panel with a front cover securing mechanism, a top panel and a rear panel with two back cover securing mechanisms; the key ring attachment portion extending outwardly from the channel shaped cover portion and including a key ring receiving aperture formed through an attachment end thereof; the controller key ring insertion opening cover including a channel shaped cover portion including a curved front panel with a front securing mechanism and a front cover indent, a left top panel, a right top panel, a rear panel with a back cover indent and two back securing mechanisms; the controller key ring insertion opening cover including a controller key ring portion pass through opening formed between the left and right top panels.

It is a still further object of the invention to provide a car alarm controller holder system that accomplishes some or all of the above objects in combination.

Accordingly, a car alarm controller holder system is provided. The car alarm controller holder system includes a main holder assembly, a key ring attachable insertion opening cover, and a controller key ring insertion opening cover; the main holder assembly including a replaceable, transparent, flexible controller access opening cover and a controller receiving member; the controller receiving member including a top insertion opening, front and back indents, a front controller access opening, a front insertion opening cover securing mechanism, and two back insertion opening cover securing mechanisms; the main holder assembly defining a controller receiving compartment therein into which a left and a right retainer channel member extends; the controller access opening cover being positioned over the front controller access opening of the controller receiving member and held in position by the left and right retainer channel members; the key ring attachable insertion opening cover including a channel shaped cover portion and a key ring attachment portion; the channel shaped cover portion including a front panel with a front cover securing mechanism, a top panel and a rear panel with two back cover securing mechanisms; the key ring attachment portion extending outwardly from the channel shaped cover portion and including a key ring receiving aperture formed through an attachment end thereof; the controller key ring insertion opening cover including a channel shaped cover portion including a curved front panel with a front securing mechanism and a front cover indent, a left top panel, a right top panel, a rear panel with a back cover indent and two back securing mechanisms; the controller key ring insertion opening cover including a controller key ring portion pass through opening formed between the left and right top panels. The securing mechanisms are preferably two-part fasteners such as snaps or hook and pile type fasteners.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
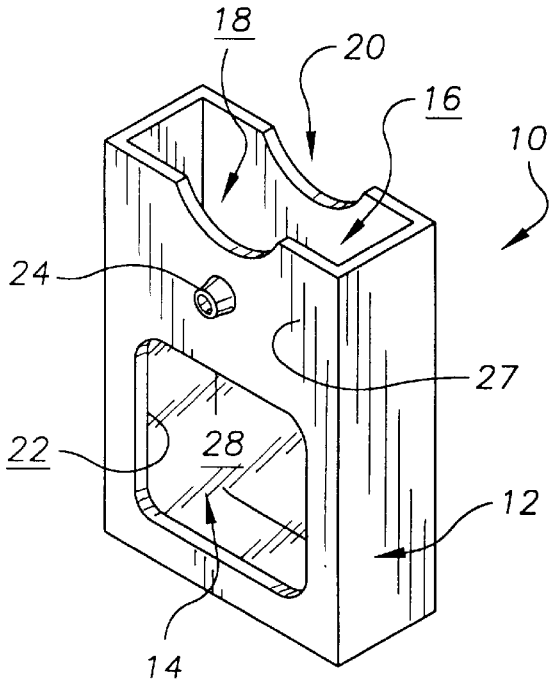
FIG. 1 is a perspective view of an exemplary embodiment of the main holder assembly of the car alarm controller holder system of the present invention showing the controller receiving member including the top insertion opening, the front and back indents, the front controller access opening, and the front insertion opening cover securing snap; and the replaceable, transparent, flexible controller access opening cover positioned over the front controller access opening of the controller receiving member.
Figure 2:
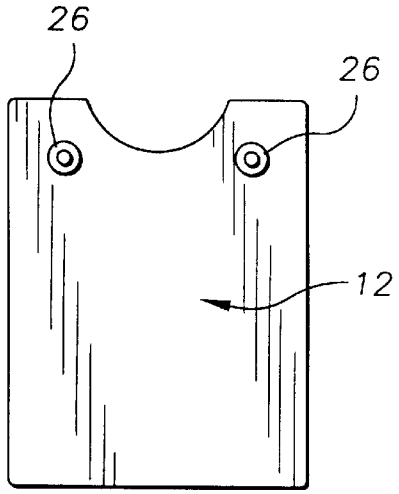
FIG. 2 is a back plan view of the exemplary main holder assembly of FIG. 1 showing the back wall, the back indent, and the two back insertion opening cover securing snaps.

FIG. 1 shows an exemplary embodiment of the main holder assembly of the car alarm controller holder system of the present invention generally designated by the numeral 10. Main holder assembly 10 includes a substantially rectangular controller receiving member, generally designated 12; and a controller access opening cover, generally designated 14. In this embodiment, controller receiving member 12 is constructed from leather and includes a top insertion opening, generally designated 16; a front indent, generally designated 18; a back indent, generally designated 20; a front controller access opening 22 that is covered by controller access opening cover 14, a front insertion opening cover securing snap 24 and two back insertion opening cover securing snaps 26 (FIG. 2). Rectangular controller receiving member 12 has a controller receiving compartment 28 formed therein that is sized to receive an alarm controller from a vehicle alarm through top insertion opening 16. Front controller access opening 22 is provided through a front side 27 of controller receiving member 12 and is sized and positioned to allow a user to see and operate the buttons on an alarm controller that is positioned within controller receiving compartment 28.

Figure 3:
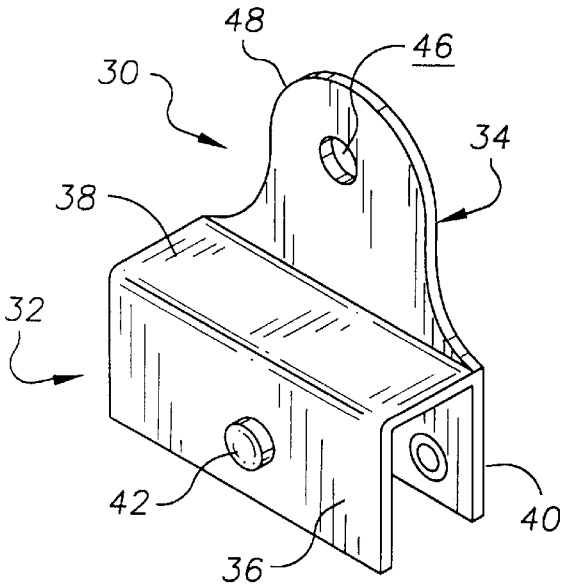
FIG. 3 is a perspective view of an exemplary embodiment of the key ring attachable insertion opening cover showing the channel shaped cover portion including the front panel with the front securing snap, the top panel and the rear panel with the two back securing snaps; and the key ring attachment portion extending outwardly from the channel shaped cover portion and including the key ring receiving aperture formed through the attachment end thereof.
Figure 4:
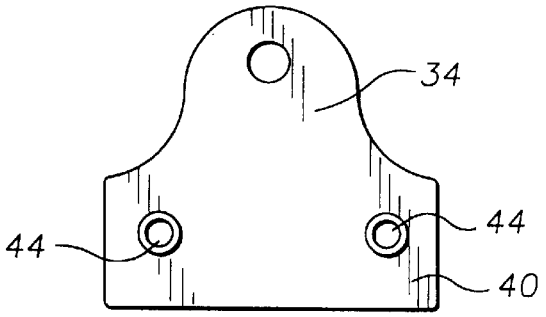
FIG. 4 is a back plan view of the exemplary key ring attachable insertion opening cover of FIG. 3 showing the rear panel of the channel shaped cover portion including the two back securing snaps; and the key ring attachment portion including the key ring receiving aperture.

FIG. 3 shows an exemplary embodiment of a key ring attachable insertion opening cover of the system of the present invention generally designated by the numeral 30. Key ring attachable insertion opening cover 30 includes a first channel shaped cover portion, generally designated 32; and a key ring attachment portion 34. In this embodiment first channel shaped cover portion 32 and key ring attachment portion 34 are constructed of leather. First channel shaped cover portion 32 includes a rectangular front panel 36, a rectangular top panel 38 and a rectangular rear panel 40. Front panel 36 has a front securing snap 42 provided therethrough that is snap connectable to front insertion opening cover securing snap 24 (FIG. 1). With reference to FIG. 4, rear panel 40 is integrally formed with key ring attachment portion 34 and has two back securing snaps 44 that are snap connectable to the two back insertion opening cover securing snaps 26 (FIG. 2). With reference back to FIG. 3, key ring attachment portion 34 extends outwardly away from first channel shaped cover portion 32 and haaperture 46 formed through aperture 46 formed through an attachment end 48 thereof that is sized to receive a key ring therethrough for attaching keys to key ring attachable insertion opening cover 30.

Figure 5:
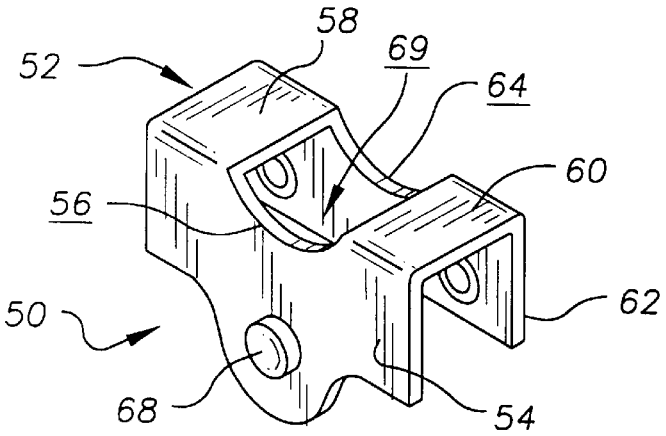
FIG. 5 is a perspective view of an exemplary embodiment of the controller key ring insertion opening cover showing channel shaped cover portion including the curved front panel with the front securing snap and the front cover indent; the left and right top panels; the rear panel with back cover indent and the two back securing snaps; and the controller key ring portion pass through opening.
Figure 6:
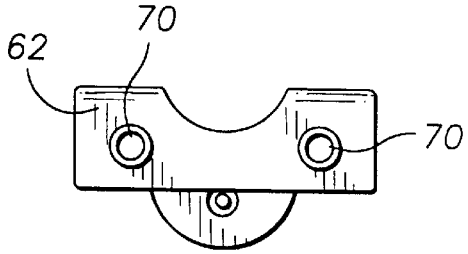
FIG. 6 is a back plan view of the exemplary controller key ring insertion opening cover of FIG. 5 showing the rear panel of the channel shaped cover portion including the back cover indent and the two back securing snaps, and the bottom portion of the curved front panel including the front securing snap.

FIG. 5 shows an exemplary embodiment of the controller key ring insertion opening cover of the holder system of the present invention generally designated by the numeral 50. Controller key ring insertion opening cover 50 includes a second channel shaped cover portion 52 that is constructed from leather and that includes a curved front panel 54 with a front cover indent 56, a left top panel 58, a right top panel 60, a rear panel 62 with a back cover indent 64. Curved front panel 54, left top panel 58, right top panel 60 and rear panel define a controller key ring portion pass through opening 69 through which the key ring attachment structure of an alarm controller can be positioned through. Curved front panel 54 has a front securing snap 68 installed therethrough that is snap connectable to front insertion opening cover securing snap 24 (FIG. 1). With reference to FIG. 6, rear panel 62 has two back securing snaps 70 that are snap connectable to the two back insertion opening cover securing snaps 26 (FIG. 2).

Figure 7:
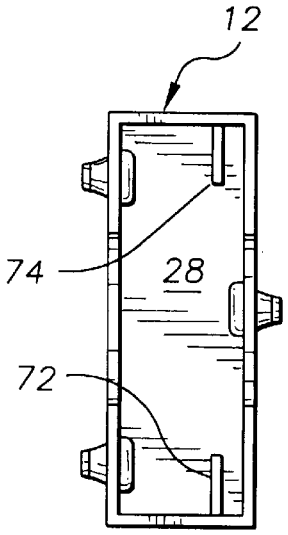
FIG. 7 is a top plan view of the exemplary controller receiving member of FIG. 1 showing the top insertion opening in connection with the controller receiving compartment formed within the controller receiving member; the front and back indents; the left and right retainer channel members extending from the left and right interior sidewalls of the controller receiving member that are used to hold the transparent, flexible controller access opening cover over the front controller access opening; the front insertion opening cover securing snap; and the two back insertion opening cover securing snaps.
Figure 8:
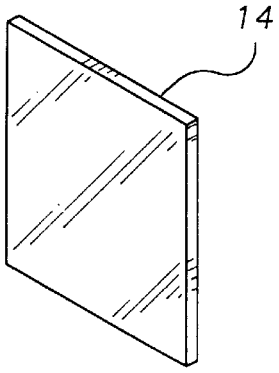
FIG. 8 is a perspective view of the rectangular shaped, replaceable, transparent, flexible controller access opening cover in isolation.
Figure 9:
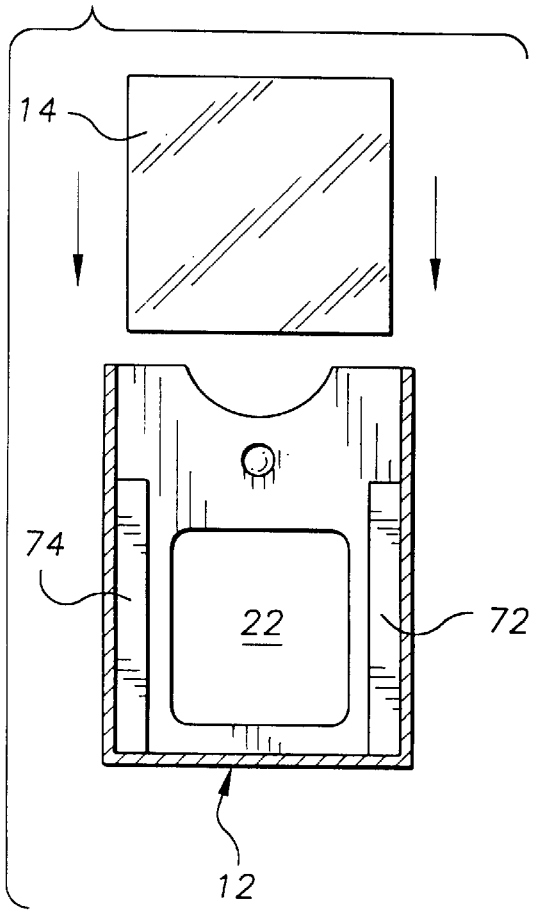
FIG. 9 is a cross-section view of the controller receiving member of FIG. 7 showing the rectangular shaped, replaceable, transparent, flexible controller access opening cover of FIG. 8 prior to insertion between the left and right retainer channel members and across the front controller access opening.

With reference now to FIG. 7, controller receiving member 12 has a left retainer channel member 72 and a right retainer channel member 74 that each extend into controller receiving compartment 28 from left and right interior sidewalls of controller receiving member 12 along either side of access opening 22 (FIG. 9). With further reference to FIG. 9, left and right retainer channel members 72,74 are used to hold transparent, flexible controller access opening cover 14 (shown in isolation in FIG. 8) in position over front controller access opening 22. In this embodiment transparent, flexible controller access opening cover 14 is constructed from a clear, transparent vinyl plastic. Should controller access opening cover 14 become scratched or stained through use, it can be easily replaced by the user.

Figure 10:
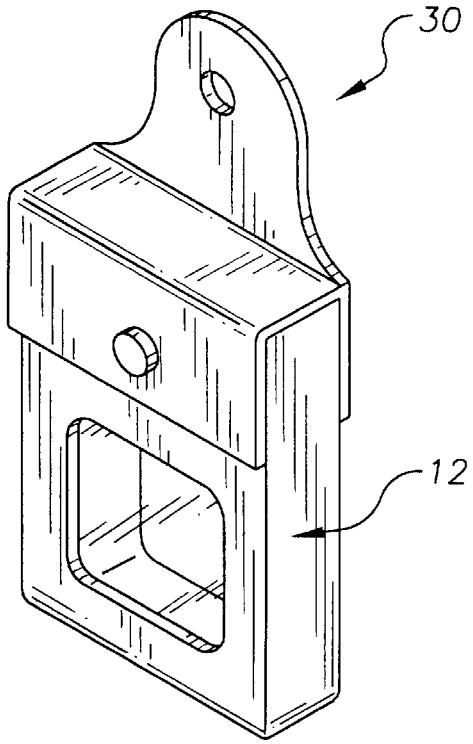
FIG. 10 is a perspective view of the key ring attachable controller access cover of FIG. 3 secured to the main holder assembly of FIG. 1.
Figure 11:
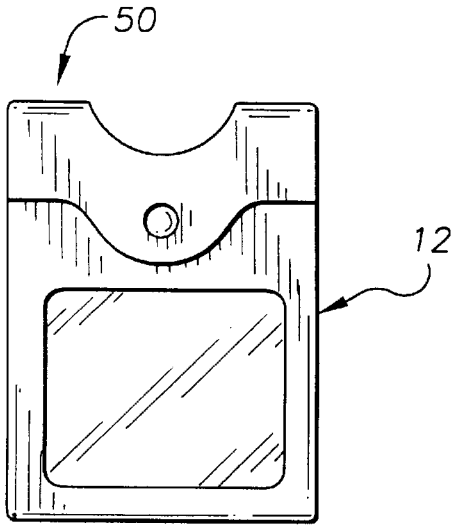
FIG. 11 is a front plan view of the controller key ring controller access cover of FIG. 5 secured to the main holder assembly of FIG. 1.

With reference to FIG. 10, in use, key ring attachable insertion opening cover 30 is snap connected to controller receiving member 12 when the alarm controller does not include a key ring attachment structure for attaching a key ring to the alarm controller; and, with reference now to FIG. 11, controller key ring insertion opening cover 50 is snap connected to controller receiving member 12 when the alarm controller does include a key ring attachment structure for attaching a key ring to the alarm controller.

It can be seen from the preceding description that a car alarm controller holder system for holding and protecting the alarm controller of a car alarm has been provided that includes an alarm controller receiving compartment within which an alarm controller can be safely contained and that includes a controller access opening that is covered by a transparent, flexible controller access opening cover; that includes a controller access opening that is covered by a replaceable transparent, flexible controller access opening cover; that includes a main holder assembly into which the alarm controller is positioned, a key ring attachable insertion opening cover for use with alarm controllers without a key ring attachment structure and a controller key ring insertion opening cover for use with alarm controllers that are provided with a key ring attachment structure; and that includes a main holder assembly, a key ring attachable insertion opening cover, and a controller key ring insertion opening cover; the main holder assembly including a replaceable, transparent, flexible controller access opening cover and a controller receiving member; the controller receiving member including a top insertion opening, front and back indents, a front controller access opening, a front insertion opening cover securing mechanism, and two back insertion opening cover securing mechanisms; the main holder assembly defining a controller receiving compartment therein into which a left and a right retainer channel member extends; the controller access opening cover being positioned over the front controller access opening of the controller receiving member and held in position by the left and right retainer channel members; the key ring attachable insertion opening cover including a channel shaped cover portion and a key ring attachment portion; the channel shaped cover portion including a front panel with a front cover securing mechanism, a top panel and a rear panel with two back cover securing mechanisms; the key ring attachment portion extending outwardly from the channel shaped cover portion and including a key ring receiving aperture formed through an attachment end thereof; the controller key ring insertion opening cover including a channel shaped cover portion including a curved front panel with a front securing mechanism and a front cover indent, a left top panel, a right top panel, a rear panel with a back cover indent and two back securing mechanisms; the controller key ring insertion opening cover including a controller key ring portion pass through opening formed between the left and right top panels.

It is noted that the embodiment of the car alarm controller holder system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A car alarm controller holder system comprising:

a main holder assembly;

a key ring attachable insertion opening cover; and a controller key ring insertion opening cover;

said main holder assembly including a replaceable, transparent, flexible controller access opening cover and a controller receiving member;

said controller receiving member including a top insertion opening, front and back indents, a front controller access opening, a front insertion opening cover securing mechanism, and two back insertion opening cover securing mechanisms;

said main holder assembly defining a controller receiving compartment therein;

said controller access opening cover being positioned over said front controller access opening of said controller receiving member;

said key ring attachable insertion opening cover including a first channel shaped cover portion and a key ring attachment portion;

said first channel shaped cover portion including a front panel with a front cover securing mechanism, a top panel and a rear panel with two back cover securing mechanisms;

said key ring attachment portion extending outwardly from said first channel shaped cover portion and including a key ring receiving aperture formed through an attachment end thereof;

said controller key ring insertion opening cover including a second channel shaped cover portion including a curved front panel with a front securing mechanism and a front cover indent, a left top panel, a right top panel, a rear panel with a back cover indent and two back securing mechanisms;

said controller key ring insertion opening cover including a controller key ring portion pass through opening formed between said left and right top panels.

2. The car alarm controller holder system of claim 1, wherein:

said controller receiving member is constructed of leather.

3. The car alarm controller holder system of claim 1, wherein:

said second channel shaped cover portion of said controller key ring insertion opening cover is constructed of leather.

4. The car alarm controller holder system of claim 1 wherein:

said first channel shaped cover portion of said key ring attachable insertion opening cover is constructed of leather.

5. The car alarm controller holder system of claim 1 wherein:

a left and a right retainer channel member extends into said controller receiving compartment of said main holder assembly; and said controller access opening cover is held in position over said front controller access opening of said controller receiving member by said left and right retainer channel members.

6. The car alarm controller holder system of claim 2, wherein:

said second channel shaped cover portion of said controller key ring insertion opening cover is constructed of leather.

7. The car alarm controller holder system of claim 2 wherein:

said first channel shaped cover portion of said key ring attachable insertion opening cover is constructed of leather.

8. The car alarm controller holder system of claim 2 wherein:

a left and a right retainer channel member extends into said controller receiving compartment of said main holder assembly; and said controller access opening cover is held in position over said front controller access opening of said controller receiving member by said left and right retainer channel members.

9. The car alarm controller holder system of claim 6 wherein:

said first channel shaped cover portion of said key ring attachable insertion opening cover is constructed of leather.

10. The car alarm controller holder system of claim 6 wherein:

a left and a right retainer channel member extends into said controller receiving compartment of said main holder assembly; and said controller access opening cover is held in position over said front controller access opening of said controller receiving member by said left and right retainer channel members.

11. The car alarm controller holder system of claim 9 wherein:

a left and a right retainer channel member extends into said controller receiving compartment of said main holder assembly; and said controller access opening cover is held in position over said front controller access opening of said controller receiving member by said left and right retainer channel members.

12. The car alarm controller holder system of claim 7 wherein:

a left and a right retainer channel member extends into said controller receiving compartment of said main holder assembly; and said controller access opening cover is held in position over said front controller access opening of said controller receiving member by said left and right retainer channel members.

13. The car alarm controller holder system of claim 3 wherein:

said first channel shaped cover portion of said key ring attachable insertion opening cover is constructed of leather.

14. The car alarm controller holder system of claim 3 wherein:

a left and a right retainer channel member extends into said controller receiving compartment of said main holder assembly; and said controller access opening cover is held in position over said front controller access opening of said controller receiving member by said left and right retainer channel members.

15. The car alarm controller holder system of claim 13 wherein:

a left and a right retainer channel member extends into said controller receiving compartment of said main holder assembly; and said controller access opening cover is held in position over said front controller access opening of said controller receiving member by said left and right retainer channel members.

16. The car alarm controller holder system of claim 4 wherein:

a left and a right retainer channel member extends into said controller receiving compartment of said main holder assembly; and said controller access opening cover is held in position over said front controller access opening of said controller receiving member by said left and right retainer channel members.

* * * * *